US006368022B1

(12) United States Patent
Zingerman

(10) Patent No.: US 6,368,022 B1
(45) Date of Patent: Apr. 9, 2002

(54) LIFTING SYSTEM FOR MASSIVE CONSTRUCTIONS

(76) Inventor: David Zingerman, 1615 Wilcox Ave., Los Angeles, CA (US) 90068

( * ) Notice: Subject to any disclaimer, the term of this patent is extended or adjusted under 35 U.S.C. 154(b) by 0 days.

(21) Appl. No.: 09/711,358

(22) Filed: Nov. 9, 2000

(51) Int. Cl.[7] ..... E02D 5/00
(52) U.S. Cl. ..... 405/230; 405/229
(58) Field of Search ..... 405/229, 230, 405/231, 232; 52/125.1, 126.7, 169.9; 254/29 R

(56) References Cited

U.S. PATENT DOCUMENTS 4,634,319 A 1/1987 May
4,695,203 A * 9/1987 Gregory ..... 405/230
4,854,782 A 8/1989 May
5,217,325 A * 6/1993 Freeman, III ..... 405/229
5,336,021 A * 8/1994 Freeman, III ..... 405/230
5,433,556 A * 7/1995 Freeman, III ..... 405/229
5,492,437 A * 2/1996 Ortiz ..... 405/230
5,800,094 A * 9/1998 Jones ..... 405/230
6,193,442 B1 * 2/2001 May ..... 405/232

* cited by examiner

*Primary Examiner*—Thomas B. Will
*Assistant Examiner*—Alexandra K Pechhold

(57) ABSTRACT

A lifting system for massive constructions provides a possibility to lift the solid over size and over weight objects. An improved lifting system for massive constructions includes at least one of a plurality of lifting devices, each of which comprises at least one of a plurality of main hydraulic jacks, the major jacks, the auxiliary jacks, the supports and the lifting sectional tape comprising the removable sections having the apertures for the fixing of the appropriate section in its position by the locking fingers. Each lifting device also includes a sling-traverse, a pivoting stand and a bearing respectively coupled to each other.

7 Claims, 4 Drawing Sheets

LIFTING SYSTEM FOR MASSIVE CONSTRUCTIONS

FIELD OF THE INVENTION

This invention relates to an apparatus intended to lift the massive objects (constructions) and mostly for lifting of the over size and over weight construction structures, particularly entire bridge sections and/or building structures such as solid roof assemblies and the like, which have to be lifted from their horizontal ground level initial position and to be horizontally leveled whereby the structural assembly has to be installed.

BACKGROUND OF THE INVENTION

The various types of the construction lifting devices are well known. The lifting of the massive (over size) and heavy solid construction structures is a very difficult operation and requires a specific lifting apparatus.

For example, the apparatus by U.S. Pat. No. 4,854,782 includes a pier, a sleeve mounted on the pier, a shoe connected to the base of a structure and mating with the sleeve, a lift bracket connected to the shoe and temporary lift means inserted between the sleeve and the lift bracket. The shoe is mated to the sleeve to allow substantially vertical movement of the shoe as the building is lifted. A hydraulic ram or jack inserted between the sleeve and the lift bracket serves as a temporary lifting means which, when extended, raises the structure to the desired position. Once in position, the building is permanently supported by securing the shoe to the sleeve. Thereafter, the ram and the lift bracket may be removed for use at a different site. A series of piers and lifting apparatus are usually required to support a single structure. The pier and the shoe are attached to the base of a structure. A sleeve, which acts as a means to guide the shoe and support the shoe on the pier, is placed on the pier and is adapted to mate with the shoe. In order to lift the structure, a lift bracket is attached to the shoe and a hydraulic ram or jack is inserted between the top of the sleeve and the bottom of the lift bracket. After the ram is extended to raise the structure to the desired level, pins are inserted through the shoe and shims inserted between the laterally extending plates of the sleeve and the pins driven through the shoe in order to permanently support the structure. After insertion of these permanent supports, the hydraulic ram and lift bracket may be removed and reused at a different site.

Such apparatus operates at the ground level and does not provide the structure lifting at the high levels.

Another apparatus by U.S. Pat. No. 4,634,319 includes a shoe which is attached to the structure to be lifted and which shoe received a pier driving assembly whereby a plurality of piers may be individually driven beneath the structure; there being a pier plate unit which is fitted over the top of each driven pier and then utilized to support lifting means which span the opening between the pier plate unit and the structure whereby the structure may be lifted to its ultimate desired position, there being permanent supporting means which are positioned between the pier plate unit and the structure for permanently retaining the structure in its desired position. This apparatus operates as following. The shoe is attached to the base of the structure and then the driving assembly is attached to the shoe whereby the assembly may be utilized to successively and individually drive piers beneath the structure. After the piers are driven a separate pier plate unit is fitted over the end of each of the piers, which piers have been cut off at ground level. Once in place, the pier plate unit is used to support lifting means which operate between the pier plate unit and the structure to lift the structure to the desired position. After the structure has reached this position permanent, adjustable supporting means are placed between the pier plate unit and the structure whereby to retain the structure in the desired position.

Such apparatus has the same deficiency described of the above (operates at the ground level and does not provide the structure lifting at the high levels), but is more lightweight then previous prior art.

Thus, there is a great need in the art for lifting system, employing at the same time a plurality of improved lifting devices to lift a solid, massive construction structures on the assigned high level to be installed.

OBJECT AND ADVANTAGES OF THE INVENTION

Accordingly, several objects and advantages of the present invention are to provide the lifting of the horizontally positioned solid, massive construction structures on the high level.

It is another object of the invention to provide the possibility for the horizontally positioned solid, massive construction structure installation without necessity of their preliminary sectional disassembling.

It is further object of the invention to increase the efficiency of the massive construction installation.

It is still further object of the invention to reduce the time of the massive construction installation.

Still, further objects and advantages will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

A lifting system for elevation of the massive constructions (the over size and over weight constructions) provides a possibility to lift the solid over size and over weight objects. An improved lifting system for massive constructions includes at least one of a plurality of lifting devices, each of which comprises at least one of a plurality of main hydraulic jacks, the major jacks, the auxiliary jacks, the supports and the lifting sectional tape comprising the removable sections having the apertures intended for fixing of the appropriate section in its position by the locking fingers. Each lifting device also includes a sling-traverse, a pivoting stand and a bearing, respectively coupled to each other.

DESCRIPTION OF THE PREFERRED EMBODIMENTS

Here the description of an improved system will be done in statics (as if the components of the improved lifting system are suspended in the space) with description of their relative connections to each other. The description of the functional operations of an improved system will be done hereinafter.

Figure 1:
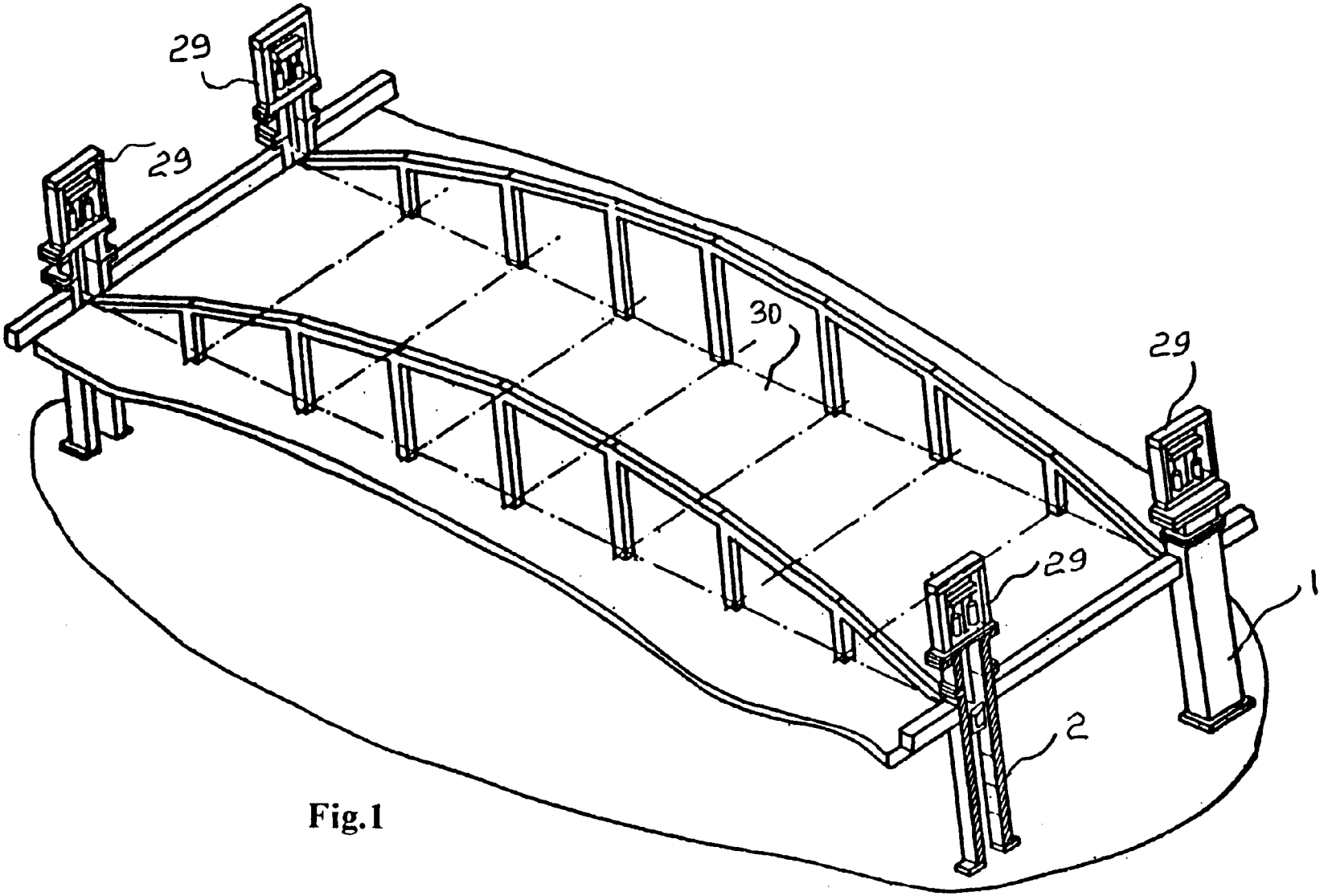
FIG. 1 is a simplified representation of an improved lifting system with a massive construction.
Figure 2:
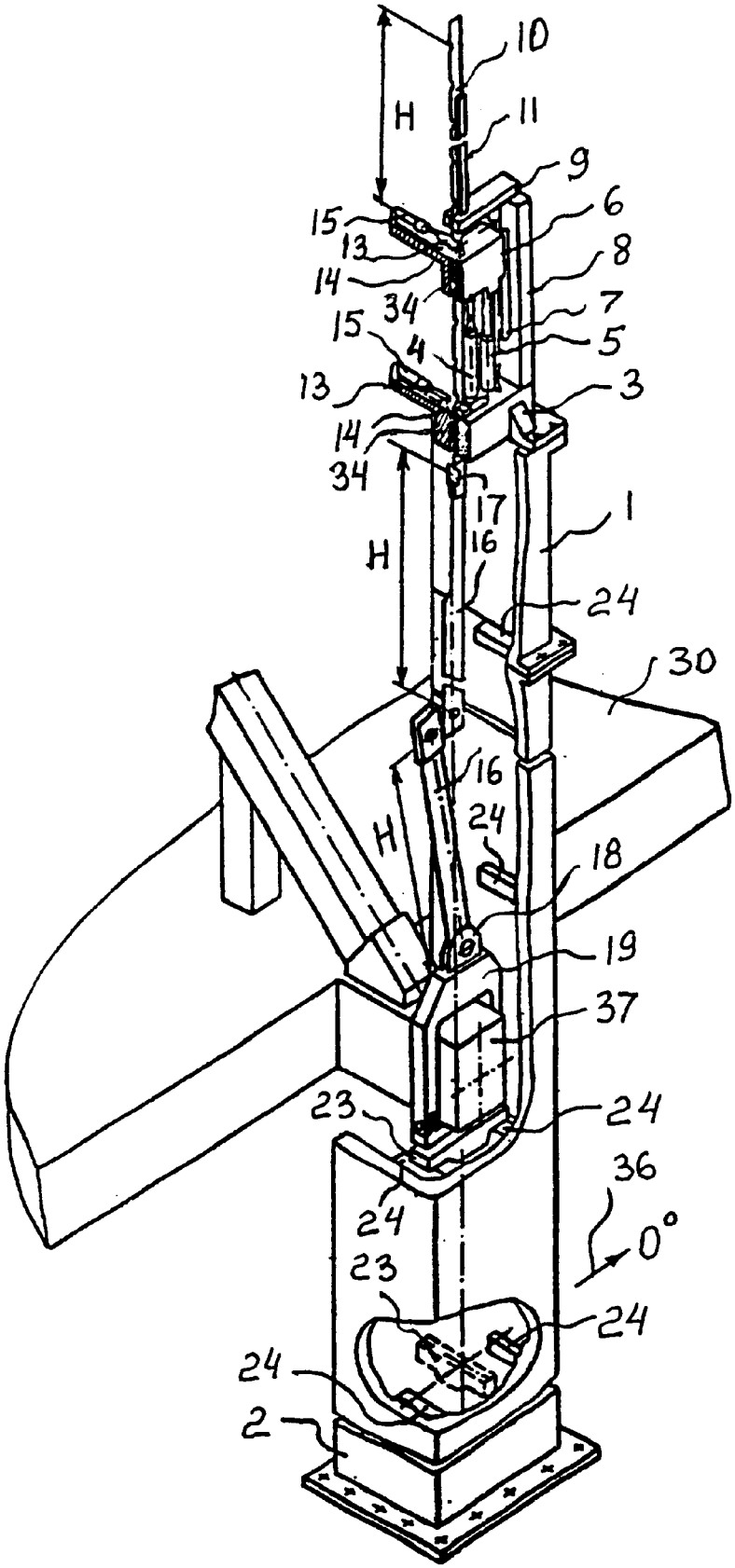
FIG. 2 is a simplified spatial view of the lifting device assembly.

An improved lifting system includes at least one of a plurality of lifting devices 29. On FIG. 1 are shown, for example, four lifting devices operating synchronously. FIG. 2 represent the lifting device 29 assembly.

Figure 3:
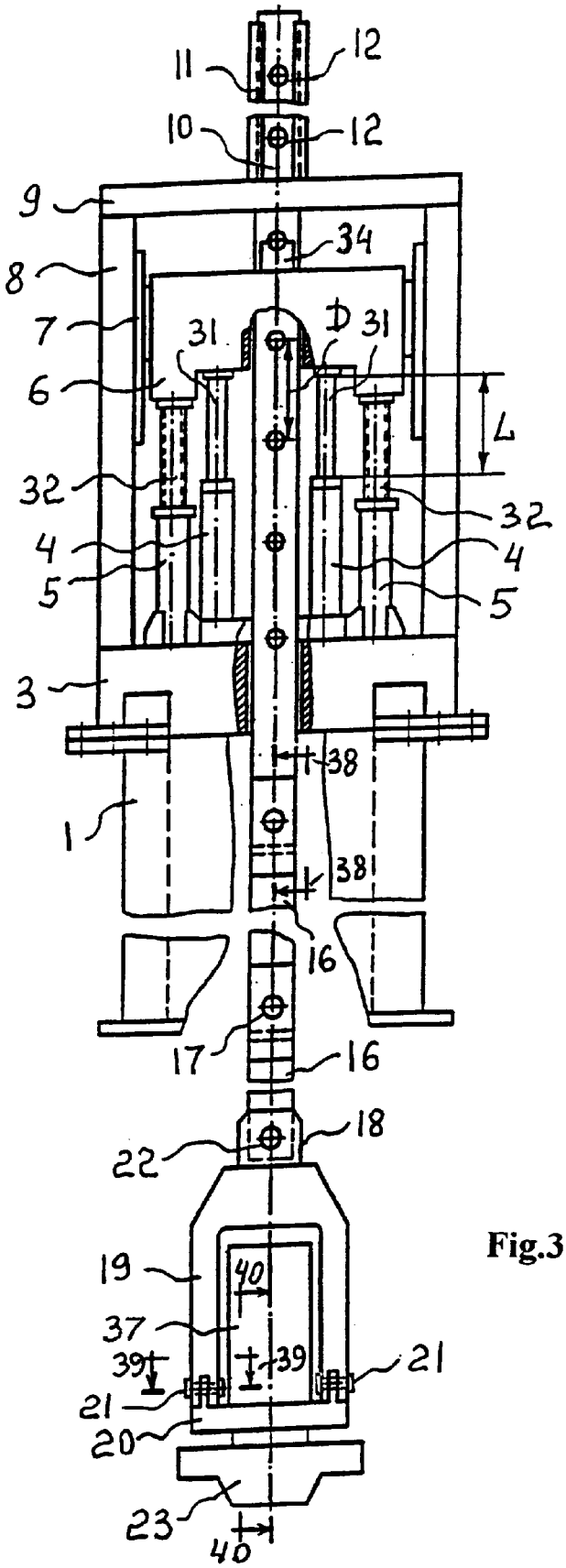
FIG. 3 is a simplified drawing of the lifting device.

Referring to FIG. 3, each improved lifting device 29 of the improved lifting system includes a support 1 rigidly connected to a column 2 of the constructing structure (for example, a column of the building such as a covered sport arena under construction, a pier of the bridge under construction or aircraft hangar, etc.). The columns 2 of the constructing building have a hollow configuration with the permanently built-in rests 24, as shown on FIG. 2. The lower girder 3 of the lifting device 29 is installed on the support 1. Also the lifting device 29 includes at least one of a plurality of main hydraulic jacks 4 (on FIG. 3 are shown, for example, two main hydraulic jacks 4). The main hydraulic jacks 4 and the major jacks 5 are connected to the lower girder 3. The upper girder 6 is installed on the rams 31 of the main hydraulic jacks 4. The upper girder 6 is fixed by the main directors 7 of the stanchions 8. The stanchions 8 provide the horizontal displacement prevention for the upper girder 6. The bottoms of the stanchions 8 are permanently connected to the lower girder 3 and their tops are connected by the lateral girder 9. The lifting (metallic) sectional tape 10 is passes trough the slits into the lower 3 and upper 6 girders, and through the slit (not shown) into the lateral girder 9. The top of the lifting sectional tape 10 (the part of the lifting tape 10, which is over the lateral girder 9)passes along the major director 11. The lifting sectional tape 10 has at least one of a plurality of removable sections 16. The sections 16 are connected to each other by the removable hinges 17, as shown on FIGS. 2, 3 and 4*a*. The length of each section 16 is mostly the same and is calculated to provide reliability to carry the heavy construction. Each section 16 has the apertures 12 in order to fix the appropriate section of the lifting sectional tape 10. The fixing of the lifting tape 10 is provided by the locking fingers (pins) 13, moved by the auxiliary jacks 15 located horizontally. Each auxiliary jack 15 has the locking finger clipping device (not shown), providing the reciprocative movement of the locking finger 13, thereby inserting the locking finger 13 into the appropriate aperture 12. The locking finger 13 is moved along the semi-cylindrical slot 14 located into the lower and upper auxiliary girder 34. The lifting device 29 includes two auxiliary girders 34, which are permanently connected to the lower 3 or upper 6 girders respectively (on FIG. 2 are shown the upper auxiliary girder 34 and the lower auxiliary girder 34). At this stage, the lifting tape 10 is hanged on the locking finger 13 which is leaned on the upper girder 6. The distance "D" between centers of the apertures 12 is the same and is adequate to the step of the main hydraulic jack 4 extension "L" for one lifting cycle (D=L).

Figure 4A:
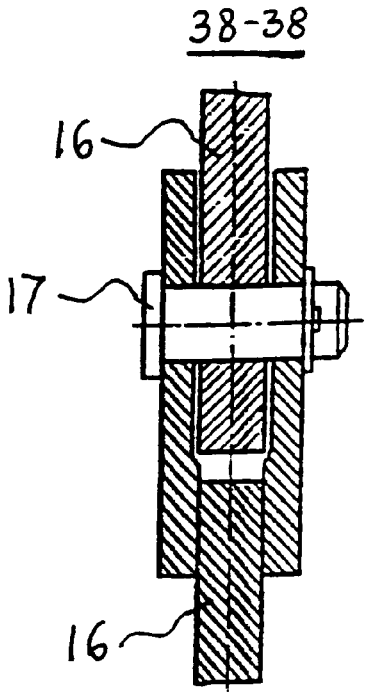
FIGS. 4*a*–4*c* are the simplified drawings of the cross-sectional views.
Figure 4B:
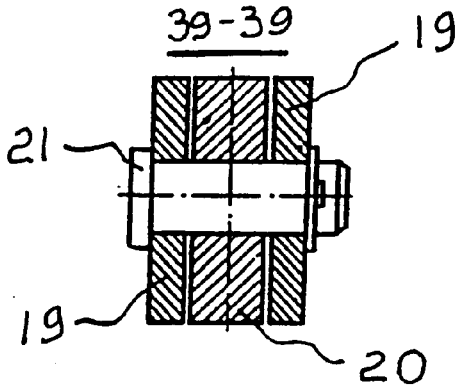
Figure 4C:
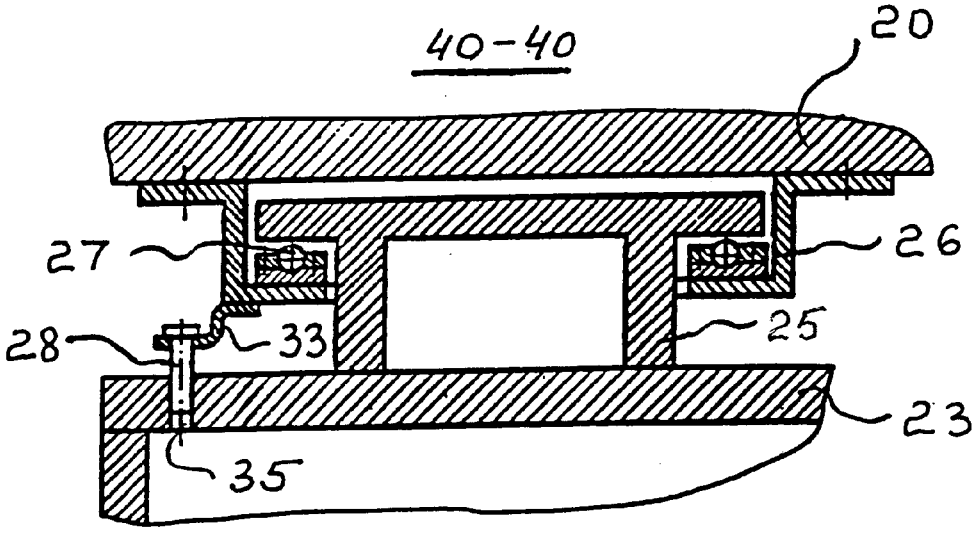

The sections 16 of the lifting tape 10 are connected to each other by the removable hinges 17, as shown on FIGS. 2, 3, and 4*a*. The step "L" of the main hydraulic jack 4 extension for one lifting cycle is also adequate to the lifting step of the lifting sectional tape 10 elevation for one lifting cycle. The quantity of the apertures 12 in one section 16 determines a quantity of the lifting cycles for this section and defines the length of the section. The quantity of the sections 16 depends on the assigned height of lifting. For example, a sport arena cover has to be lifted on 40 yard height, then if, for example, H=6 yards, the lifting device 29 includes 7 (seven) sections 16, each of which has 6 yards of distance "H" between centers of the hinges 17. The lower section 16 is coupled with the flange 18 of the sling-traverse 19 by the traverse hinge 22. The hinges 17 (and also the traverse hinge 22) provide possibility of the sequential section 16 removal after all apertures 12 of this section are used. The sling-traverse 19 is coupled with the base 20 by the auxiliary hinge 21, as shown on FIGS. 3, 4*b*. The base 20 is also coupled with the pivoting stand 23. At some positions, the pivoting stand 23 can be leaned on the rests 24 (see FIGS. 2, 4*c*). The pivoting stand 23 can be turned inside column 2 through 90° clockwise or counterclockwise, that is provided by the bearing 27, coupling two holders: the lower holder 25 and the upper holder 26, as shown on FIG. 4*c*. The lower holder 25 is permanently connected to the pivoting stand 23 and the upper holder 26 is permanently connected to the base 20. At the lifting cycle, the lower holder 25 is hanged on the upper holder 26 via bearing 27. The bracket 33 is permanently connected to the base 20 and provides (by the fixing finger 28 and the pivoting stand aperture 35) a fixing of the pivoting stand 23 at the one of three fixed positions: −90°, 0°, +90° in respect to the direction 36.

The improved lifting system operates as follows. In the initial position, the lifting tape 10 of each of a plurality of lifting devices 29 (for example, each of four synchronously operating lifting devices 29, as shown on FIG. 1) is coupled (by the locking finger 13 inserted in the highest aperture 12 of the lifting tape 10) with the appropriate upper girder 6. The insertion of the locking finger 13 in the aperture 12 is provided by the auxiliary jack 15. The corbel 37 of the construction 30 is inserted into the sling-traverses 19 of each lifting device 29 (see FIG. 2).

For the lifting of the construction, the drives (not shown) of the main hydraulic jacks 4 are synchronously turned-on and the rams 31 are synchronously raised, thereby lifting the appropriate upper girders 6. When the first cycle of the lifting is completed (the rams 31 are in the final extended position), the treaded rams 32 of the major jack 5 uprise at their final extended (upper) position to insure the position of the ram 31 of the main hydraulic jacks 4 (the final extended position of the treaded rams 32 can be adequate to the final extended position of the rams 31, depending on the upper girder 6 form/configuration). At this stage, the lower locking finger 13 (by the lower auxiliary jack 15) is inserted in the appropriate lower aperture 12 of the lifting tape 10 (see FIG. 2). The upper locking finger 13 is pulled out of the highest aperture 12, the auxiliary jacks 15 are released (pulled down), the drives (not shown) of the main hydraulic jacks 4 are synchronously turned-off releasing the rams 31, thereby moving the upper girder 6 down. At this stage, the lifting tape 10 holds the construction 30. Then, the upper locking finger 13 is inserted in the next (lower) aperture 12 (the next aperture 12, that is lower the previous aperture 12), the lower locking finger 13 is pulled out of its aperture 12, and the lifting device is ready for the next lifting cycle. During each lifting cycles, the pivoting stand 23 is in ±90° position (perpendicularly to the direction 35).

The rests 24 are permanently installed inside column 2, as it is mentioned above and shown on FIG. 2. The rests 24 are used to release the lifting tape 10 of a load, for example, in the emergency (e.g., storm, etc.) or at the time of the sections 16 removal. In such situations, the main hydraulic jacks 4 raises the upper girder 6, which pulls the lifting tape 10 up, thereby lifting the loaded sling-traverse 19. The sling-traverse 19 pulls the base 20 up. At this stage, the pivoting stand 23 is got off the rests 24. The level of the pivoting stand 23 at the end of elevation is a little over the level of the rests 24. Then, the fixing finger 28 is removed; the pivoting stand 23 is turned in 0°, and the fixing finger 28 is installed in the appropriate for 0° position aperture 35. After that, the main hydraulic jacks 4 pulls the upper girder 6 down, which pulls the lifting tape 10 down, thereby pulling down: the loaded sling-traverse 19, the base 20 and the pivoting stand 23, thereby leaning the pivoting stand 23 on the rests 24.

Thus, an improved lifting system for massive constructions provides the lifting of the solid over weight and over size objects from their horizontal ground level initial position and to be horizontally leveled whereby the structural assembly has to be installed.

CONCLUSION, RAMIFICATION AND SCOPE

Accordingly the reader will see that, according to the invention, I have provided a lifting system for massive solid constructions. An improved lifting system for massive constructions has various possibilities, considering activities of the lifting devices.

While the above description contains many specificities, these should be not construed as limita-tions on the scope of the invention, but as exemplification of the presently-preferred embodiments thereof Many other ramifications are possible within the teaching to the invention. For example, an improved lifting system for massive solid constructions provides simplification of the technological cycles of construction work and eliminate the necessity and labor-intensive process of the cover block assembling on the top of building. Also some buildings, further intended for precise scientific researches, require the performance of all inside construction work to be done in as much as clean inside environment and a priory determined climatical conditions.

Thus, the scope of the invention should be determined by the appended claims and their legal equivalents, and not by examples given.

What is claimed is:

1. A lifting system for massive constructions comprising at least one of a plurality of lifting devises, each of which includes:

a support connected to a column;

a lower girder installed on said support;

at least one of a plurality of main hydraulic jacks installed on said lower girder;

an upper girder installed on rams of said main hydraulic jacks;

at least one of a plurality of major jacks installed on said lower girder;

a lifting sectional tape coupled with a sling-traverse;

a base coupled with said sling-traverse;

a pivoting stand connected to a lower holder;

an upper holder connected to said base;

a bearing installed between said lower holder and said upper holder.

2. The lifting system of claim 1, wherein said lower girder is connected to stanchions, which are also connected to a lateral girder, and wherein between said stanchions is moved said upper girder.

3. The lifting system of claim 1, wherein said lower girder, said upper girder and a lateral girder have a slit for said lifting sectional tape passage.

4. The lifting system of claim 1, wherein said lifting sectional tape has at least one of a plurality of sections, and wherein said sections connected to each other by removable hinges.

5. The lifting system of claim 4, wherein each of said sections has apertures with a distance between centers of said apertures adequate to a length of an extension of said main hydraulic jack and adequate to the length of the lifted tape.

6. The lifting system of claim 1, wherein said lifting sectional tape during a lifting cycle is hanged on a locking finger, which is leaned on said upper girder.

7. The lifting system of claim 1, wherein said massive construction has a corbel, which is inserted in said sling-traverse.

* * * * *